US009863264B2

(12) United States Patent
Kulkarni et al.

(10) Patent No.: US 9,863,264 B2
(45) Date of Patent: Jan. 9, 2018

(54) TURBINE SHROUD ENGAGEMENT ARRANGEMENT AND METHOD

(71) Applicant: General Electric Company, Schenectady, NY (US)

(72) Inventors: Shruti Kulkarni, Karnataka (IN); Venkata Ramana Murthy Hemadribhotla, Karnataka (IN); Ajay Gangadhar Patil, Greer, SC (US)

(73) Assignee: General Electric Company, Schenectady, NY (US)

( * ) Notice: Subject to any disclaimer, the term of this patent is extended or adjusted under 35 U.S.C. 154(b) by 1315 days.

(21) Appl. No.: 13/709,620

(22) Filed: Dec. 10, 2012

(65) Prior Publication Data

US 2014/0161596 A1 Jun. 12, 2014

(51) Int. Cl.

| | |
|---|---|
| ***F01D 11/08*** | (2006.01) |
| ***F01D 9/04*** | (2006.01) |
| ***F01D 25/24*** | (2006.01) |

(52) U.S. Cl.

CPC ..... *F01D 11/08* (2013.01); *F01D 9/04* (2013.01); *F01D 25/246* (2013.01); (Continued)

(58) Field of Classification Search

CPC ..... F01D 9/04; F01D 11/08; F01D 25/246; F05D 2230/60; F05D 2240/11; Y10T 29/49323

See application file for complete search history.

(56) References Cited

U.S. PATENT DOCUMENTS 4,332,523 A 6/1982 Smith
5,988,975 A * 11/1999 Pizzi ..... F01D 11/005 415/139

(Continued)

FOREIGN PATENT DOCUMENTS

EP 1156188 A2 11/2001
EP 2166194 A2 3/2010

(Continued)

OTHER PUBLICATIONS

European Search Report issued in connection with corresponding EP Application No. 13196018.9 dated May 29, 2017.

(Continued)

*Primary Examiner* — Igor Kershteyn

(74) *Attorney, Agent, or Firm* — Ernest G. Cusick; Frank A. Landgraff

(57) ABSTRACT

According to one aspect of the invention a turbine shroud engagement arrangement includes an outer shroud and an inner shroud operably connectable to the outer shroud. The outer shroud has at least one of a channel formed in and a protruding member extending from an inner radial surface thereof. The inner shroud has at least one of a protruding member extending from an outer radial surface thereof that is complementary to the at least one channel of the outer shroud or a channel formed in the outer radial surface that is complementary to the at least one protruding member of the outer shroud. The turbine shroud engagement arrangement is primarily axially slidably engagable and configured to radially support the inner shroud relative to the outer shroud.

19 Claims, 5 Drawing Sheets

(52) U.S. Cl.
CPC ..... *F05D 2230/60* (2013.01); *F05D 2240/11* (2013.01); *Y10T 29/49323* (2015.01)

(56) References Cited

U.S. PATENT DOCUMENTS 6,200,091 B1 * 3/2001 Bromann ..... F01D 11/18 415/173.1
6,315,519 B1 11/2001 Bagepalli et al.
6,814,538 B2 * 11/2004 Thompson ..... F01D 11/08 29/889.1
6,821,085 B2 * 11/2004 Darkins, Jr. ..... F01D 11/08 415/116
7,044,709 B2 * 5/2006 Bruce ..... F01D 9/04 415/135
7,278,820 B2 * 10/2007 Keller ..... F01D 11/08 415/173.1
7,377,742 B2 5/2008 Shapiro et al.
7,600,967 B2 * 10/2009 Pezzetti, Jr. ..... F01D 11/005 415/115
8,585,357 B2 * 11/2013 DiPaola ..... F01D 9/04 415/173.6
2009/0148277 A1 6/2009 Tholen et al.

FOREIGN PATENT DOCUMENTS

JP 59222566 A 12/1984
JP 63230910 A 9/1988
JP 2007326207 A 12/2007
JP 2011241805 A 12/2011

OTHER PUBLICATIONS

Japanese Office Action issued in connection with corresponding JP Application No. JP2013246848 dated Sep. 26, 2017.

* cited by examiner

TURBINE SHROUD ENGAGEMENT ARRANGEMENT AND METHOD

BACKGROUND OF THE INVENTION

The subject matter disclosed herein relates to turbine shrouds and more specifically to systems and methods for attaching such shrouds to one another.

BRIEF DESCRIPTION OF THE INVENTION

According to one aspect of the invention a turbine shroud engagement arrangement includes an outer shroud having at least one of a channel formed in and a protruding member extending from an inner radial surface thereof and an inner shroud operably connectable with the outer shroud having at least one of a protruding member extending from an outer radial surface thereof that is complementary to the at least one channel of the outer shroud or a channel formed in the outer radial surface that is complementary to the at least one protruding member of the outer shroud. The turbine shroud engagement arrangement is primarily axially slidably engagable and configured to radially support the inner shroud relative to the outer shroud.

According to another aspect of the invention, a method of attaching an inner shroud to an outer shroud of a turbine includes primarily axially slidably engaging a protruding member of at least one of an inner shroud or an outer shroud into a channel in the other of the inner shroud and the outer shroud.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
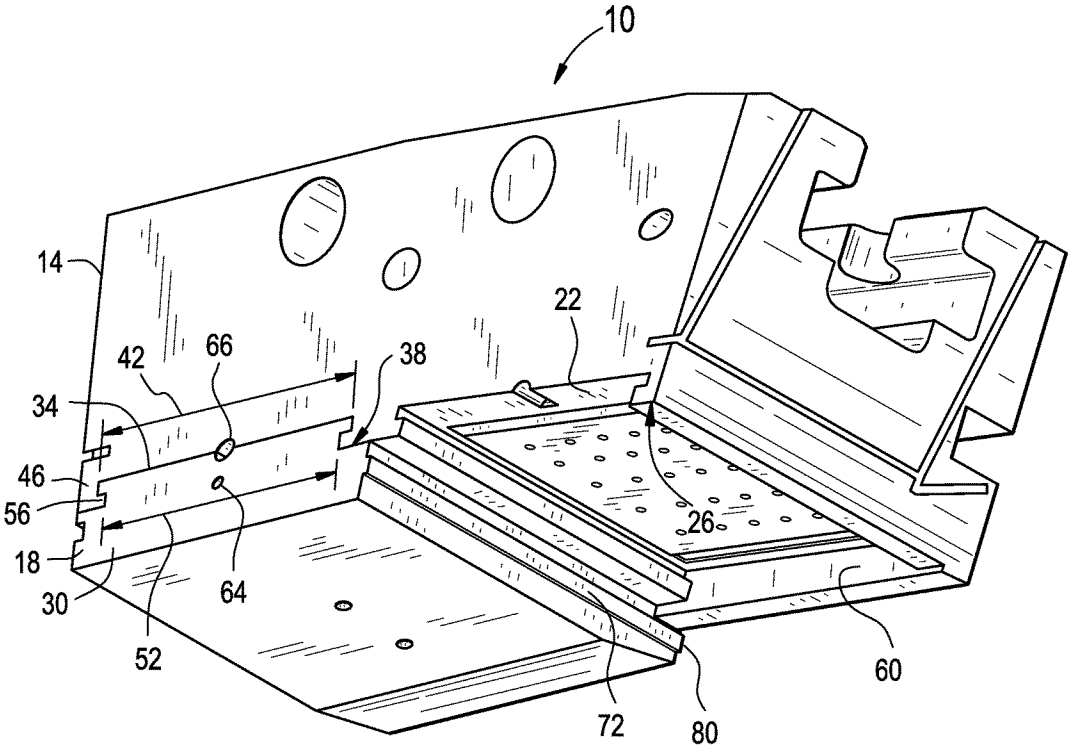
FIG. 1 depicts a perspective view of an embodiment of a turbine shroud engagement arrangement disclosed herein with a portion of an inner shroud removed.
Figure 2:
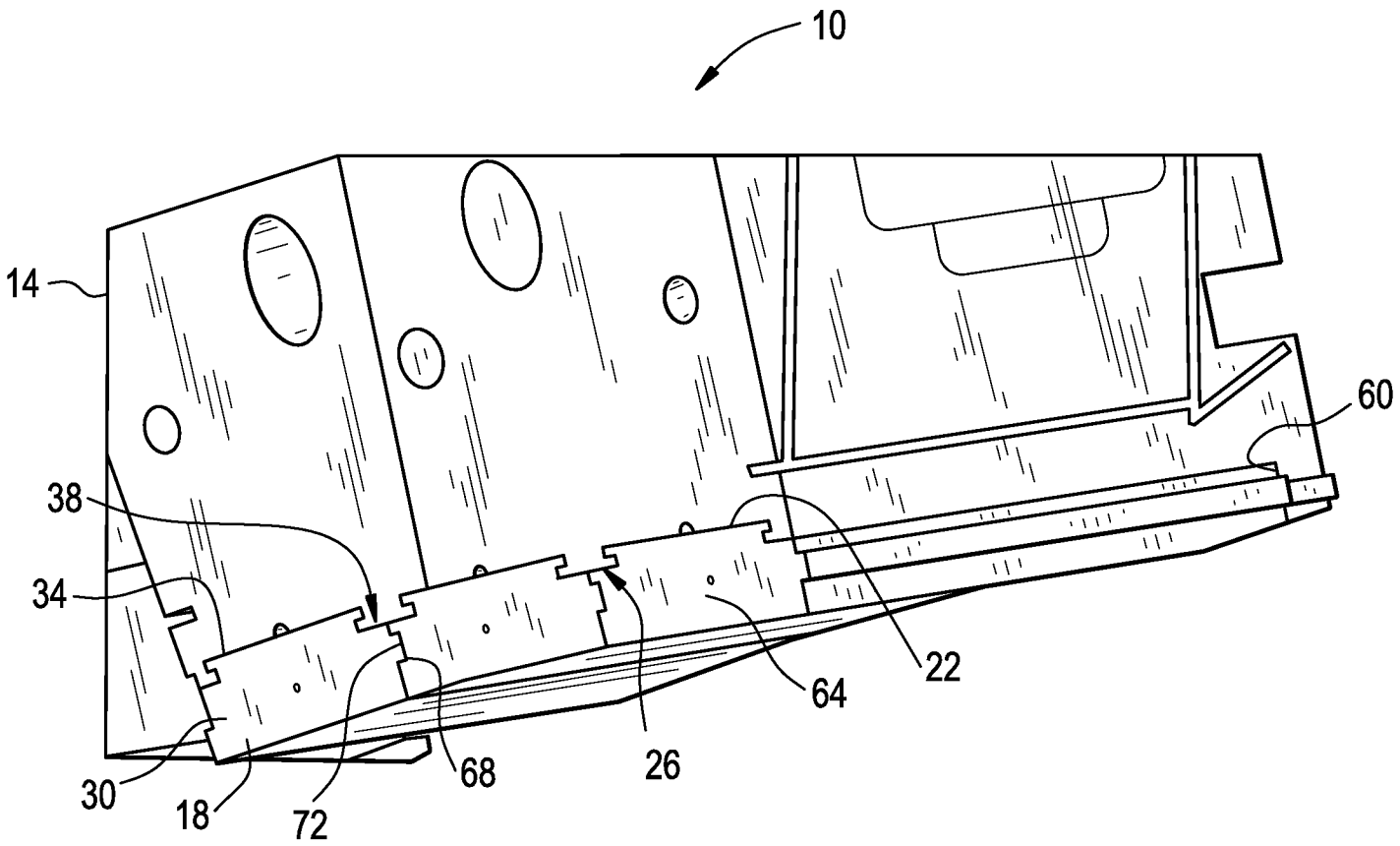
FIG. 2 depicts an alternate perspective view of the turbine shroud engagement arrangement of FIG. 1.

Referring to FIGS. 1 and 2, an embodiment of a turbine shroud engagement arrangement is illustrated at 10. The shroud engagement arrangement 10 includes an outer shroud 14 and an inner shroud 18 engagable therewith. The outer shroud 14 has a channel 22 formed on an inner radial surface 26 thereof, while the inner shroud 18 has a body 30 with a protruding member 34 extending radially outwardly of an outer radial surface 38 thereof. The protruding member 34 is configured such that a perimetrical dimension 42 at a distal portion 46 is greater than a perimetrical dimension 52 at a proximal portion 56. In this embodiment the protruding member 34 is T-shaped, and is slidably engagable in the channel 22 that has a cross sectional shape that is complementary to that of the protruding member 34 and, as such, in this embodiment also is T-shaped. The inner shroud 18 is therefore radially retained by the outer shroud 14 by the engagement of the protruding member 34 within the channel 22. Although not specifically illustrated, other configurations of the protruding member 34 and the channel 22 are contemplated such as a dove tail configuration, for example. Also, the parts on which the protruding member 34 and the channel 22 are formed could be swapped. That is the protruding member 34 could extend from the inner radial surface 26 of the outer shroud 14 and the channel 22 could be formed in the outer radial surface 38 of the inner shroud 18 while not deviating from the invention disclosed herein. Additionally, the body 30 could be part of the outer shroud 14 instead of being part of the inner shroud 18.

The slidable engagement of the protruding member 34 into the channel 22 is primarily in an axial direction, the axial direction being defined as parallel to an axis of the turbine. As such, primarily axial herein means that the slidable engagement has a greater axial component than non-axial component. In fact, the shroud engagement arrangement 10 of this embodiment has only an axial component. In contrast, the embodiment of FIGS. 6 and 7 includes a non-axial component as will be elaborated on below. Additionally this embodiment has a shoulder 60 on one end of the channel 22 that serves as a stop to prevent further axial movement of the body 30 relative to the outer shroud 14.

The outer shroud 14 illustrated has a single piece construction while the inner shroud 18 is formed of a plurality of the bodies 30. Each of the bodies 30 has one of the protruding members 34 slidably engagable with one of the channels 22. This configuration allows each of the bodies 30 to be removable from the outer shroud 14 independently of the other bodies 30, thereby simplifying removal and repair in the field, for example.

A detail 64, illustrated herein as a threaded hole, in each of the bodies 30 allows a tool such as a threaded rod (not shown) to threadable engage therewith to aid in slidably removing the bodies 30 from the outer shroud 14. Alternate configurations of the detail 64 are contemplated, that provide for attachment of a tool to axially pull on the bodies 30 relative to the outer shroud 14, such as a cross pin (not shown) in a recess, for example. The shrouds 14 and 18 can also include a feature 66 to axially lock them together and thereby resist inadvertent axial movement of one relative to the other. The feature 66 illustrated herein is a threaded hole formed half in the outer shroud 14 and half in the inner shroud 18 that is receptive to a threaded rod engagable therewith.

Figure 3:
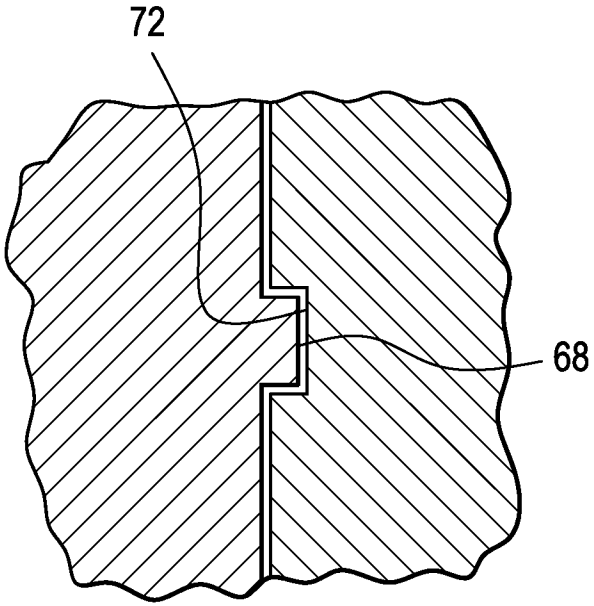
FIG. 3 depicts a cross sectional view of a tortuous seal employed in the embodiment of FIGS. 1 and 2.

Each of the bodies 30 in this embodiment is further configured to sealingly engage with each of the other bodies 30 that are located perimetrically adjacent thereto. Such sealing engagement may be via tortuous paths formed by complementary shapes on each perimetrical side of the bodies 30. For example, each of the bodies 30 may have a square tongue 68 on one side and a square groove 72 on the other (as is illustrated in FIGS. 1, 2 and 3) such that the tongue 68 slidably engages with the groove 72 when being installed in the outer shroud 14.

Figure 4:
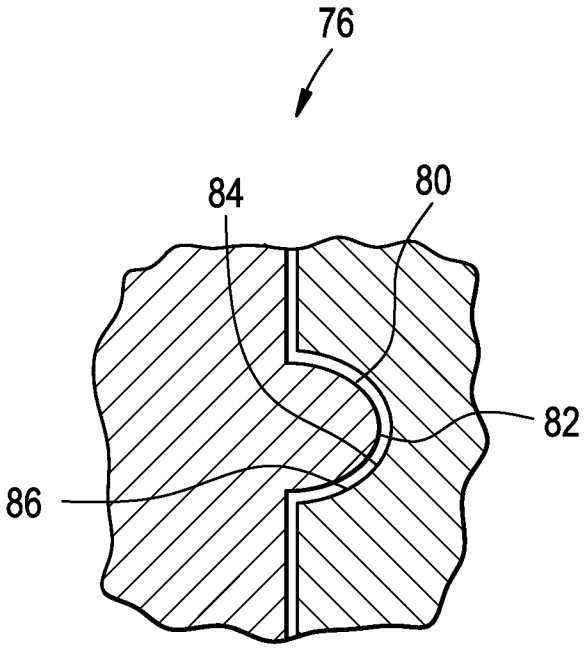
FIG. 4 depicts a cross sectional view of an alternate tortuous seal disclosed herein.

Referring to FIG. 4, an alternate tortuous path configuration is illustrated at 76. The tortuous path 76 of this embodiment employs a tongue 80 having a protrusion 82, that slidably engages with a complementary groove 84. It should be noted that other configurations of seal arrangements are contemplated including seals that employ more than one of the tongues 68, 80 and grooves 72, 84 and combinations thereof.

Figure 5:
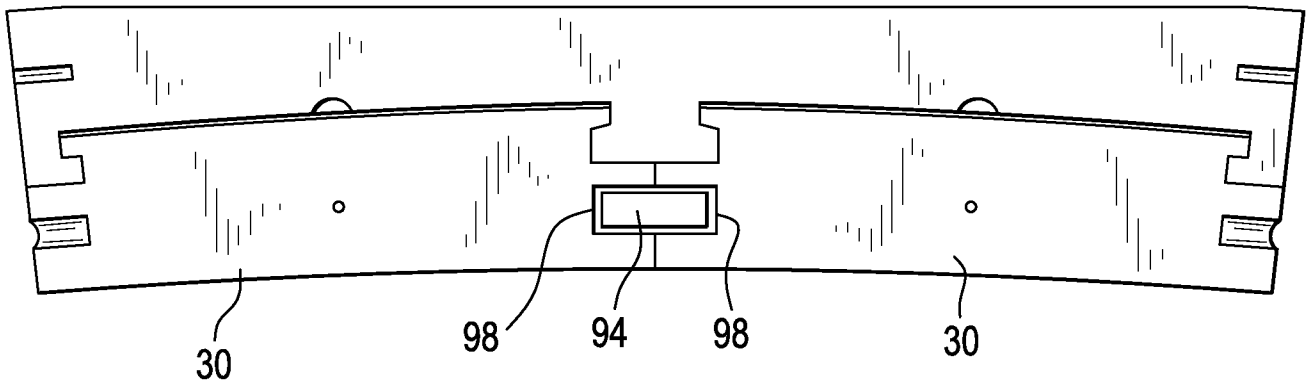
FIG. 5 depicts an end view of an alternate embodiment of a turbine shroud engagement arrangement disclosed herein.

Referring to FIG. 5, alternately the sealing engagement could include a separate seal element 94 configured to be positioned between and sealingly engaged with adjacent bodies 30. In the embodiment shown, each body 30 has a groove 98 on each perimetrical side thereof that is receptive to the seal element 94. Although the seal element 94 and the grooves 98 are shown with rectangular cross sections alternate embodiments could employ elements and groove having any practical cross sectional shape.

Figure 7:
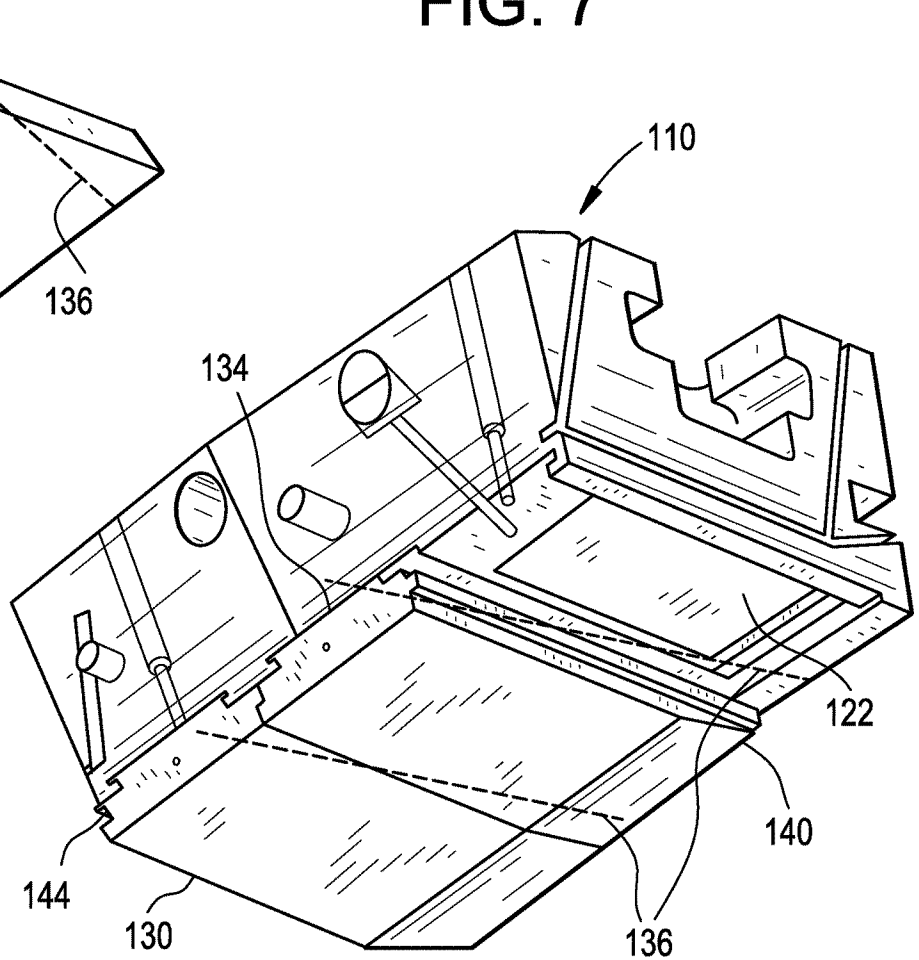
FIG. 7 depicts a perspective view of the embodiment of FIG. 6 with a portion of the inner shroud removed.
Figure 6:
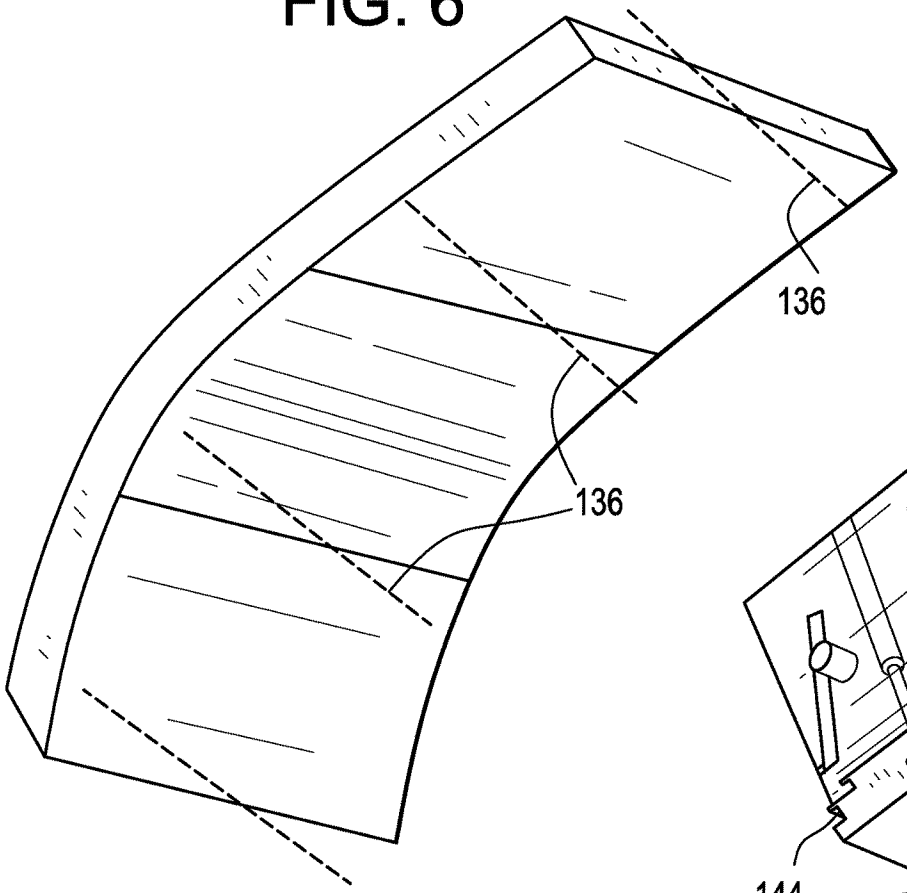
FIG. 6 depicts a schematic view of an alternate embodiment of a turbine shroud engagement arrangement disclosed herein.

Referring to FIGS. 6 and 7, an alternate embodiment of a turbine shroud engagement arrangement disclosed herein is illustrated at 110. The engagement arrangement 110 differs from the arrangement 10 in that the primarily axial sliding engagement of a protruding member 134 into a channel 122 includes a non-axial component. That is the sliding engagement of the body 130 as the protruding member 134 enters the channel 122 moves in a non-axial direction in addition to the primarily axial direction. In this embodiment the body 130 moves radially inwardly along dashed lines 136 such that when completely installed the leading end 140 of the protruding member 134 is positioned radially inwardly of the trailing end 144. Still other alternate embodiments could be configured such that bodies include a perimetrical component of movement as they are engaged instead of or in addition to the radial component of movement.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbine shroud engagement arrangement, comprising an outer shroud having a channel formed in an inner radial surface thereof and two protruding members extending from an inner radial surface thereof; and an inner shroud operably connectably mating with the outer shroud, the inner shroud having a body, a protruding member extending from an outer radial surface thereof being complementary to the channel of the outer shroud and a channel formed in the outer radial surface being complementary to the protruding member of the outer shroud, a distance between the protruding members of the outer shrouds being greater than a distance of the channel of the outer shroud, the turbine shroud engagement arrangement being primarily axially slidably engageable and configured to radially support the inner shroud relative to the outer shroud.

2. The turbine shroud engagement arrangement of claim 1, wherein at least one of the outer shroud and the inner shroud includes at least one body defining the inner radial surface or the outer radial surface.

3. The turbine shroud engagement arrangement of claim 2, wherein the at least one body is a plurality of bodies.

4. The turbine shroud engagement arrangement of claim 3, wherein each of the plurality of bodies sealingly engages with two of the plurality of bodies positioned perimetrically adjacent thereto.

5. The turbine shroud engagement arrangement of claim 4, wherein a sealing engagement extends over an axial length of the plurality of bodies.

6. The turbine shroud engagement arrangement of claim 5, wherein the sealing engagement includes a separate element positioned within grooves formed in the plurality of bodies.

7. The turbine shroud engagement arrangement of claim 4, wherein each of the plurality of bodies has a tongue on one side and a groove on the other such that the tongue of one of the plurality of bodies engages with a groove on an adjacent one of the plurality of bodies.

8. The turbine shroud engagement arrangement of claim 7, wherein the tongue and the groove form a tortuous path.

9. The turbine shroud engagement arrangement of claim 2, wherein at least one of the at least one body has a detail configured to allow a tool to engage therewith to apply an axial load to axially withdraw the at least one body.

10. The turbine shroud engagement arrangement of claim 9, wherein the detail is a threaded hole.

11. The turbine shroud engagement arrangement of claim 2, wherein the protruding member has a larger perimetrical dimension located distally of the at least one body than proximally of the at least one body.

12. The turbine shroud engagement arrangement of claim 1, wherein the channel has a shoulder that the protruding member contacts to limit axial movement of between the inner shroud and the outer shroud.

13. The turbine shroud engagement arrangement of claim 1, wherein the outer shroud and the inner shroud have a feature to axially lock them together.

14. The turbine shroud engagement arrangement of claim 13, wherein the feature is half of a threaded hole such that a threaded member engaged in the half threaded hole of the outer shroud and the half threaded hole of the inner shroud prevents axial movement between the outer shroud and the inner shroud.

15. The turbine shroud engagement arrangement of claim 13, wherein the primarily axially is only axially.

16. A turbine shroud engagement arrangement, comprising an outer shroud having at least one of a channel formed in an inner radial surface thereof and a protruding member extending from an inner radial surface thereof; and an inner shroud operably connectable with the outer shroud having at least one of a protruding member extending from an outer radial surface thereof being complementary to the channel of the outer shroud or a channel formed in the outer radial surface being complementary to the protruding member of the outer shroud, the turbine shroud engagement arrangement being primarily axially slidably engagable and configured to radially support the inner shroud relative to the outer shroud, wherein the protruding member has a T-shaped cross section.

17. A method of attaching an inner shroud to an outer shroud of a turbine, comprising primarily axially slidably engaging a protruding member of at least one of an inner shroud or an outer shroud into a channel in the other of the inner shroud and the outer shroud, further comprising radially retaining the inner shroud to the outer shroud by engaging a T-shape of the protruding member in a T-shape cavity defined by the channel.

18. The method of attaching an inner shroud to an outer shroud of a turbine of claim 17, further comprising axially fixing the inner shroud to the outer shroud.

19. The method of attaching an inner shroud to an outer shroud of a turbine of claim 17, further comprising sealing perimetrical sides of at least one body of one of the outer shroud and the inner shroud to perimetrical sides of another at least one body positioned adjacent thereto.

* * * * *